US006345697B1

(12) United States Patent
Siikonen

(10) Patent No.: US 6,345,697 B1
(45) Date of Patent: Feb. 12, 2002

(54) PROCEDURE FOR CONTROLLING AN ELEVATOR GROUP WHERE VIRTUAL PASSENGER TRAFFIC IS GENERATED

(75) Inventor: Marja-Liisa Siikonen, Helsinki (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 09/547,054

(22) Filed: Apr. 10, 2000

Related U.S. Application Data

(63) Continuation of application No. PCT/FI98/00791, filed on Oct. 10, 1998.

(30) Foreign Application Priority Data

Oct. 10, 1997 (FI) ..... 973927
Oct. 10, 1997 (FI) ..... 973928

(51) Int. Cl.[7] ..... B66B 1/18
(52) U.S. Cl. ..... 187/382; 187/247
(58) Field of Search ..... 187/380, 382, 187/323, 386, 387, 391, 392, 247

(56) References Cited

U.S. PATENT DOCUMENTS 4,030,572 A 6/1977 Kaneko et al.
4,355,705 A * 10/1982 Schroder et al. ..... 187/29 R
4,411,337 A * 10/1983 Schroder et al. ..... 187/29 R
4,536,842 A 8/1985 Yoneda et al.
4,718,520 A * 1/1988 Schroder ..... 187/127
4,947,965 A * 8/1990 Kuzunuki et al. ..... 187/127
5,022,497 A 6/1991 Thanagavelu
5,354,957 A * 10/1994 Robertson ..... 187/247
5,616,896 A * 4/1997 Kontturi et al. ..... 187/384
5,780,789 A * 7/1998 Tsuji ..... 187/382
5,955,708 A * 9/1999 Amano et al. ..... 187/247

FOREIGN PATENT DOCUMENTS

EP 0565864 * 3/1993
EP A1565864 10/1993
JP 331173 * 8/1991

* cited by examiner

*Primary Examiner*—Jonathan Salata

(57) ABSTRACT

As elevator group including at least two elevator cars is controlled using a group control unit which allocates the calls to different elevators. Based on statistical data and/or statistical forecasts, virtual passenger traffic is generated and used in a simulation that creates events in the virtual passenger traffic, on the basis of which an elevator-specific cost is computed for each call to be allocated. Based on the costs, the best elevator is selected to serve the call. This allocation of a best elevator to answer a specific landing call may be reallocated as the simulation is updated to update the best elevator to answer a specific floor call.

9 Claims, 5 Drawing Sheets

PROCEDURE FOR CONTROLLING AN ELEVATOR GROUP WHERE VIRTUAL PASSENGER TRAFFIC IS GENERATED

This application is a Continuation of PCT International Application No. PCT/FI98/00791 filed on Oct. 10, 1998, which designated the United States, and on which priority is claimed under 35 U.S.C. § 120, the entire contents of which are hereby incorporated by reference.

FIELD OF THE INVENTION

The present invention relates to a procedure for controlling ling an elevator group.

The function of elevator group control is to allocate the landing calls to the elevators in the group. The allocation of landing calls in group control may depend on factors such as load situation of the elevator group, number and disposition of calls, and instantaneous load, position and travelling direction of the elevators. In modern group control, attention is also paid to controlling passenger behavior. Call allocation in group control is the result of an optimisation task in which various parameters related to travelling comfort and other aspects of elevator use are optimized. Such parameters include e.g. waiting time, advance signalling capability, energy consumption, transport capacity, travelling time and equalization of car load. In modern microprocessor based control systems it is possible to optimize several parameters simultaneously.

Advance signalling is an important part of passenger guidance. Advance signalling is used to guide the passengers at a timely stage to the vicinity of the doors of an elevator arriving at a floor. Advance signalling does not require the use of extraordinary call button arrangements at the landing. Timely advance signalling or immediate assignment of the elevator to be allocated to the call can be best accomplished by using a control system with future-oriented simulation in which possible future situations have already been taken into account when signalling is being given or an elevator is being assigned to a call. EP patent specification 568 937 presents a procedure for controlling an elevator group in which future situations are taken into account. This procedure uses a decision analysis which is executed each time when an elevator arrives at a point where the system has to decide which one of alternative solutions is to be selected (e.g. passing by or stopping at a floor). The decision analysis examines the effects resulting from different alternative control actions by simulating the behavior of the system in the situation after the decision. In this procedure, a decision is made at two different terminations: At the starting point, where the elevator is standing at a landing with doors closed and ready to depart, and at the stopping point, where the elevator is moving and arrives at the deceleration point of the destination floor.

GB patent specification 2 235 311 presents a group control method for an elevator system in which a suitable control algorithm is selected by simulating different control modes and selecting control parameters corresponding to specified target values. In this method, statistics are maintained about the distribution of car calls issued for a given floor. This information is utilised in predicting stoppages due to car calls. However, the prediction ends with the call being served and does not actually take into account any events subsequent to the point of time when the calls are served.

SUMMARY OF THE INVENTION

The object of the present invention is to improve the existing group control procedures. Among other things, it is an object of the invention to achieve a better ability to anticipate future situations so as to facilitate advance signalling and allocation of calls to the elevators. It is also an object of the invention to ensure better consideration of both the states of the elevators and the situation regarding landing calls when allocating elevators to landing calls. In the procedure of the invention, the instant of decision is associated with the activation of a new landing call. In other words, primarily no decisions are made when there are no active landing calls. At the instant of decision, probable future landing calls are simulated, and these are allocated to the elevators in accordance with an optimum policy by calculating simulated costs and a new call is allocated to the one of the elevators whose use will result in the lowest cost on an average. In simulating the future, passengers are generated for different floors in proportion to arrival intensity and distribution; similarly, car commands are generated in accordance with probable intensities of passengers leaving the elevators. A call is not finally reserved until in a certain time window. In practice, thanks to improved forecasts of future situations, the invention makes it possible to achieve an improved accuracy and stability of call allocation in group control.

According to the invention, simulation and call reallocation can be performed even for old calls that are only going to be served after a certain length of time, which means that the simulation of future operation regarding these calls can be performed using even calls that in reality have been registered only after this call.

BRIEF DESCRIPTION OF THE DRAWINGS

In the following, the invention will be described in detail by the aid of an example by referring to the attached drawings, wherein.

DETAILED DESCRIPTION OF PREFERRED EMBODIMENT

Figure 1:
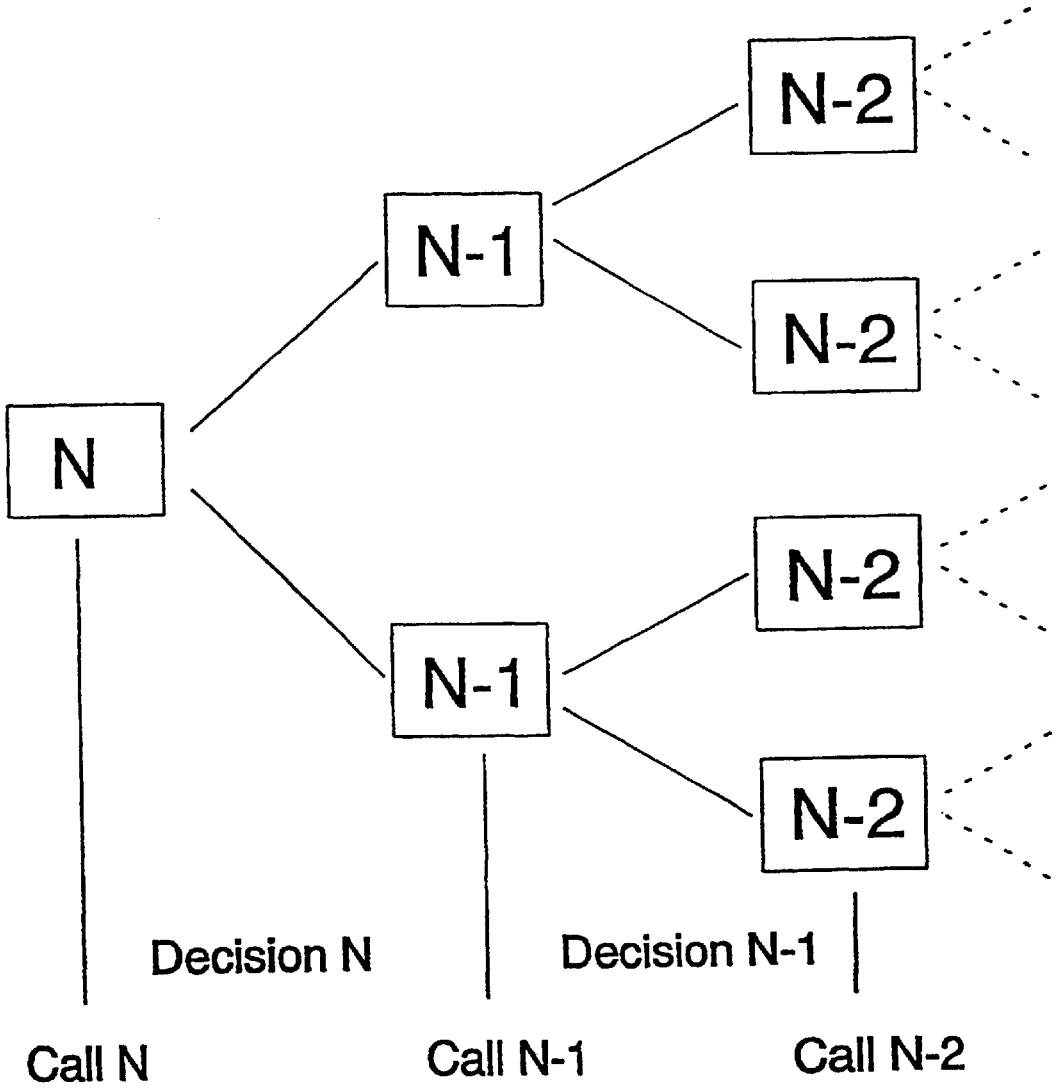
FIG. 1 presents a tree diagram of decisions in an elevator group comprising two elevators.
Figure 6:
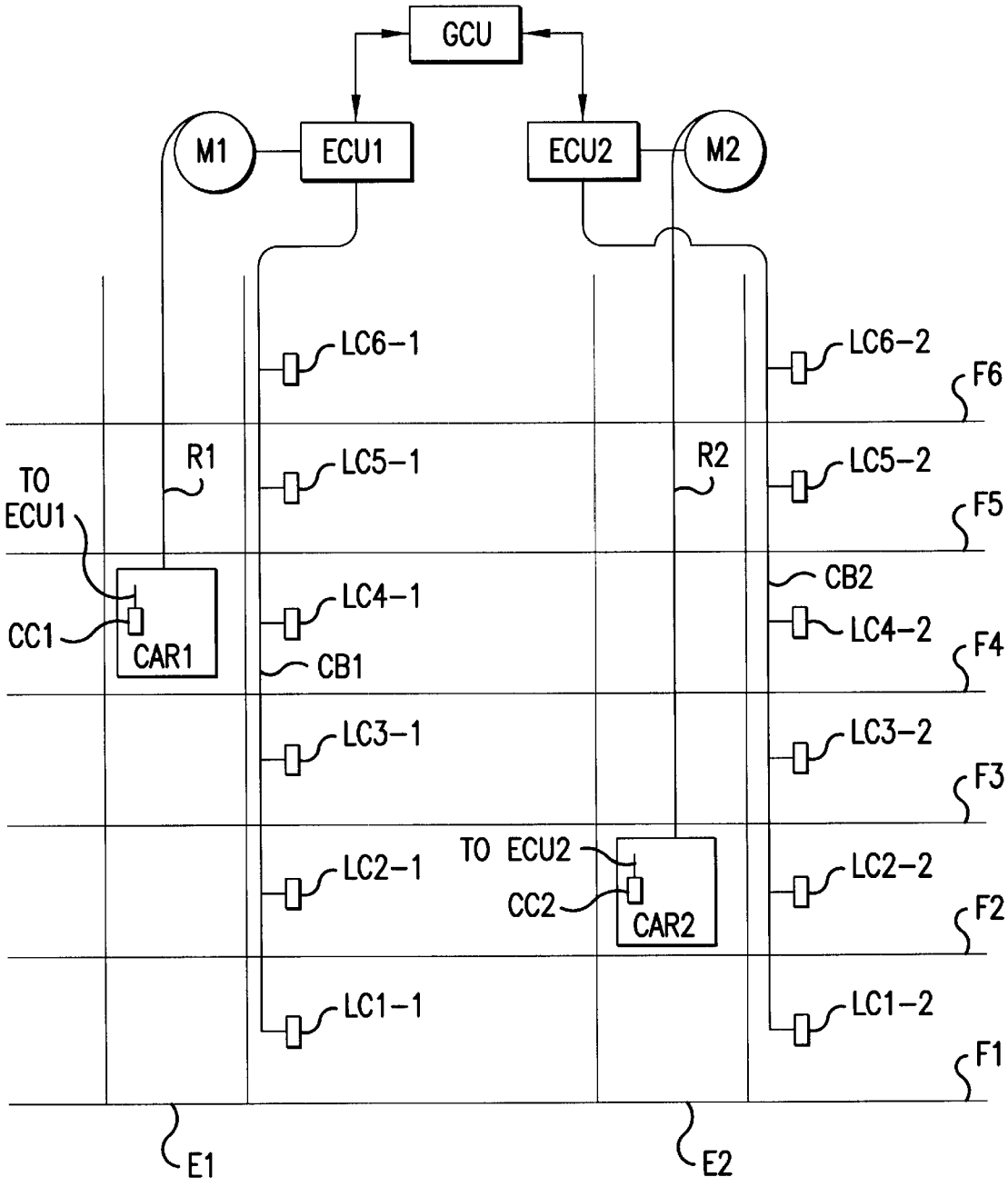
FIG. 6 is a schematic illustration of a two elevator group under group control.

FIG. 1 shows a tree diagram of decisions for N calls in an elevator E1, E2 as illustrated in FIG. 6 group comprising two elevators. Each car in the group, Car1 and Car2, travels in its own elevator shaft, suspended on hoisting ropes R1, R2. The elevators are driven by hoisting motors M1, M2. The motors are controlled by a microprocessor-based regulating unit in accordance with commands issued by an elevator control unit. Each control unit ECU1, ECU2 is further connected to a microprocessor-base group control unit ECU1, ECU2 which distributes the control commands to the elevator control units GCU. Placed inside the elevator cars are car call buttons CC1, CC2 and possibly also display devices for the display of information for passengers. Correspondingly, the landings are provided with landing call buttons LCI-1 to LCG1 and LC1-2 to LCG-2 and display devices as appropriate. For control of the elevator group, the call buttons are connected via a communication bus CB1, CB2 to the elevator control units to transmit call data to the elevator control units ECU1, ECU2 and further to the group control unit GCU.

All calls (CallN, CallN-1, CallN-2) are allocated to the elevators and the costs for each decision (DecisionN, DecisionN-1) are calculated. The route involving the lowest cost yields an optimal call allocation. When there are N calls and the number of elevators is 1, the decision tree comprises 1" route combinations to be computed.

Figure 2:
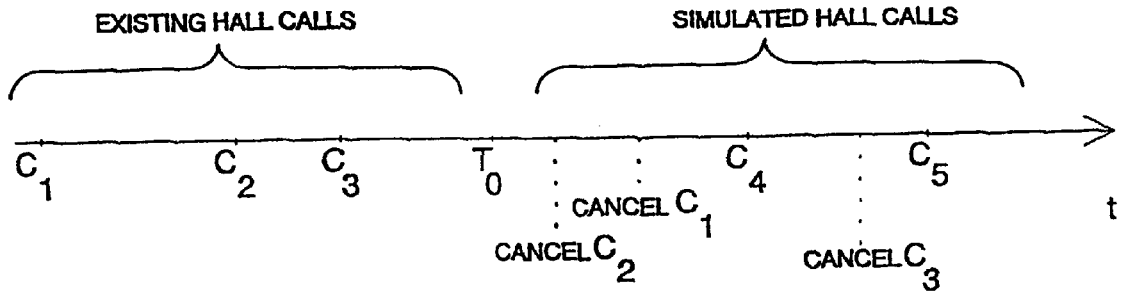
FIG. 2 presents landing calls on a time axis.
Figure 3:
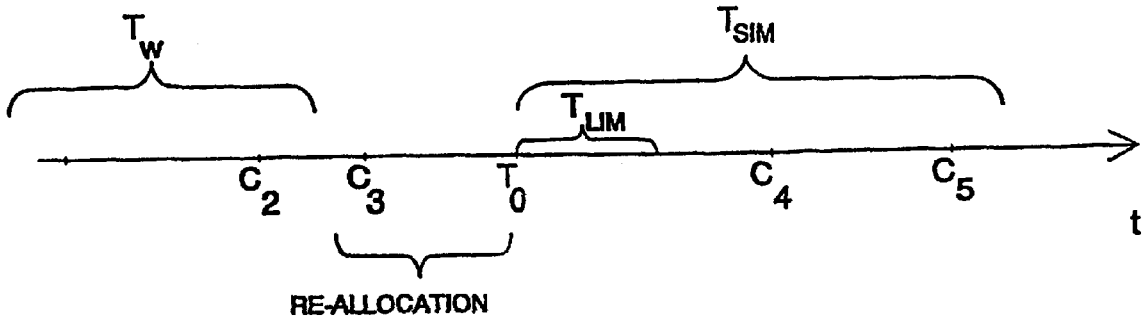
FIG. 3 presents a time window.

FIG. 2 presents the existing landing calls (hall calls) $C_1$–$C_3$ and simulated landing calls (hall calls) $C_4$, $C_5$ after the lapse of $T_{sim}$ on a time axis t where the current instant is represented by $T_0$. A landing call is removed from the call queue when the elevator serving the call arrives at the floor concerned. In the solution of the invention, the call is not finally allocated until in a given time window (FIG. 3) $T_w$, where the travel time (ETA, Estimated Time of Arrival) of the elevator for the call is shorter than a preselected time $T_{Lim}$. In the simulation of the future, persons are generated for different floors in proportion to the arrival intensities and distribution, and car commands are similarly generated according to probable intensities of passengers leaving the elevator, in other words, according to predictions regarding passengers arriving at each destination floor and leaving the elevator car.

The forecasts for the intensities of passengers arriving and leaving the elevator are obtained for each floor and each direction by using a so-called traffic predictor included in the Group Control Unit GCU. Statistics representing intensities of passengers arriving and leaving the elevator, measured e.g. from the load weight and photocell data, are accumulated in the traffic predictor. Using the statistics, an arrival time, arrival floor and destination floor are assigned for each simulated person. The simulated persons press simulated landing call buttons, and elevator traffic is simulated according to the next stopping floor used in the simulation, selected by the control system. The simulation is repeated in the same way for each decision alternative.

Simulated calls can be allocated by using known control principles, such as collective control or an ACA algorithm (ACA=Adaptive Call Allocation).

Each time a new call is registered, simulation is immediately performed for different elevators and the call is allocated to the one that can serve it at minimum costs. Simulation and call re-allocation can also be performed for old calls (FIG. 3) which are only to be served after the lapse of $T_{Lim}$. Therefore, calls that have actually been registered after a first call can initially be used in the simulation of future operation regarding the first call.

Figure 4:
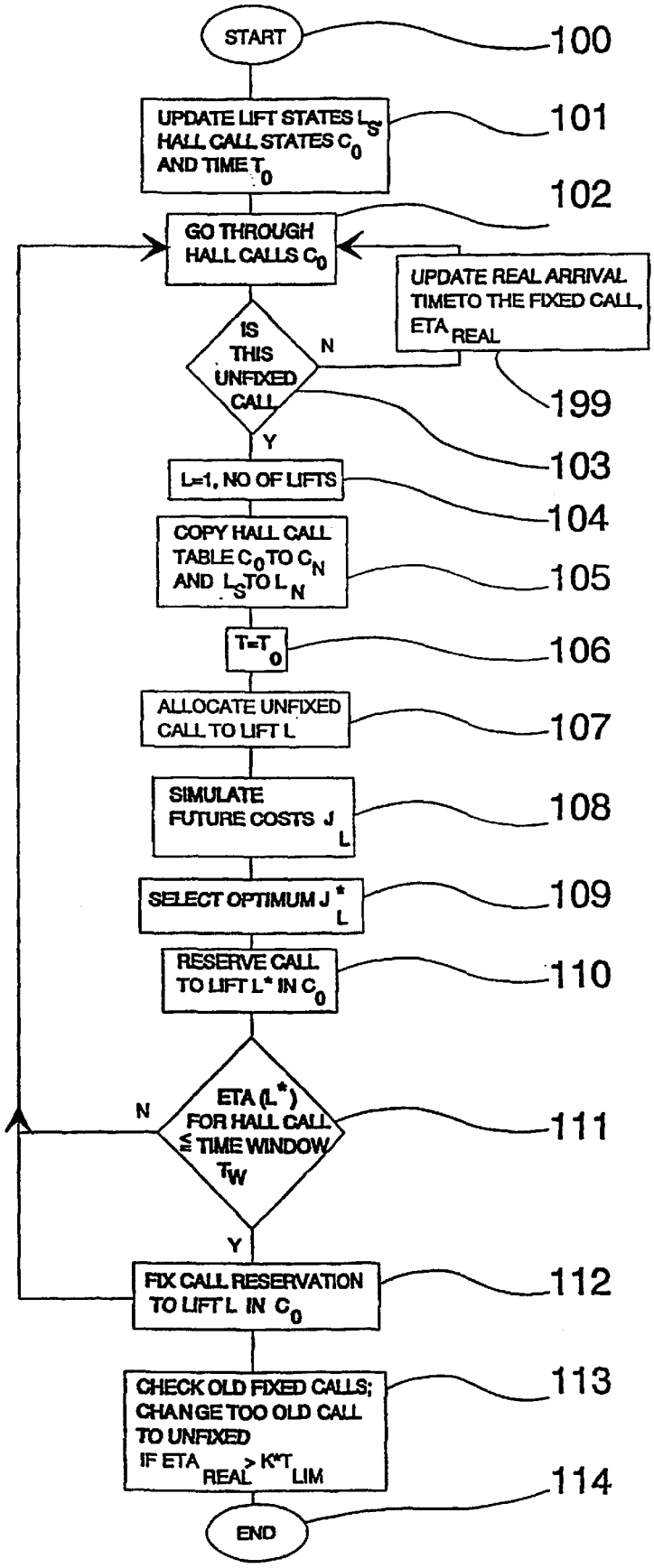
FIG. 4 presents a block diagram applicable for implementng the procedure of the invention.
Figure 5:
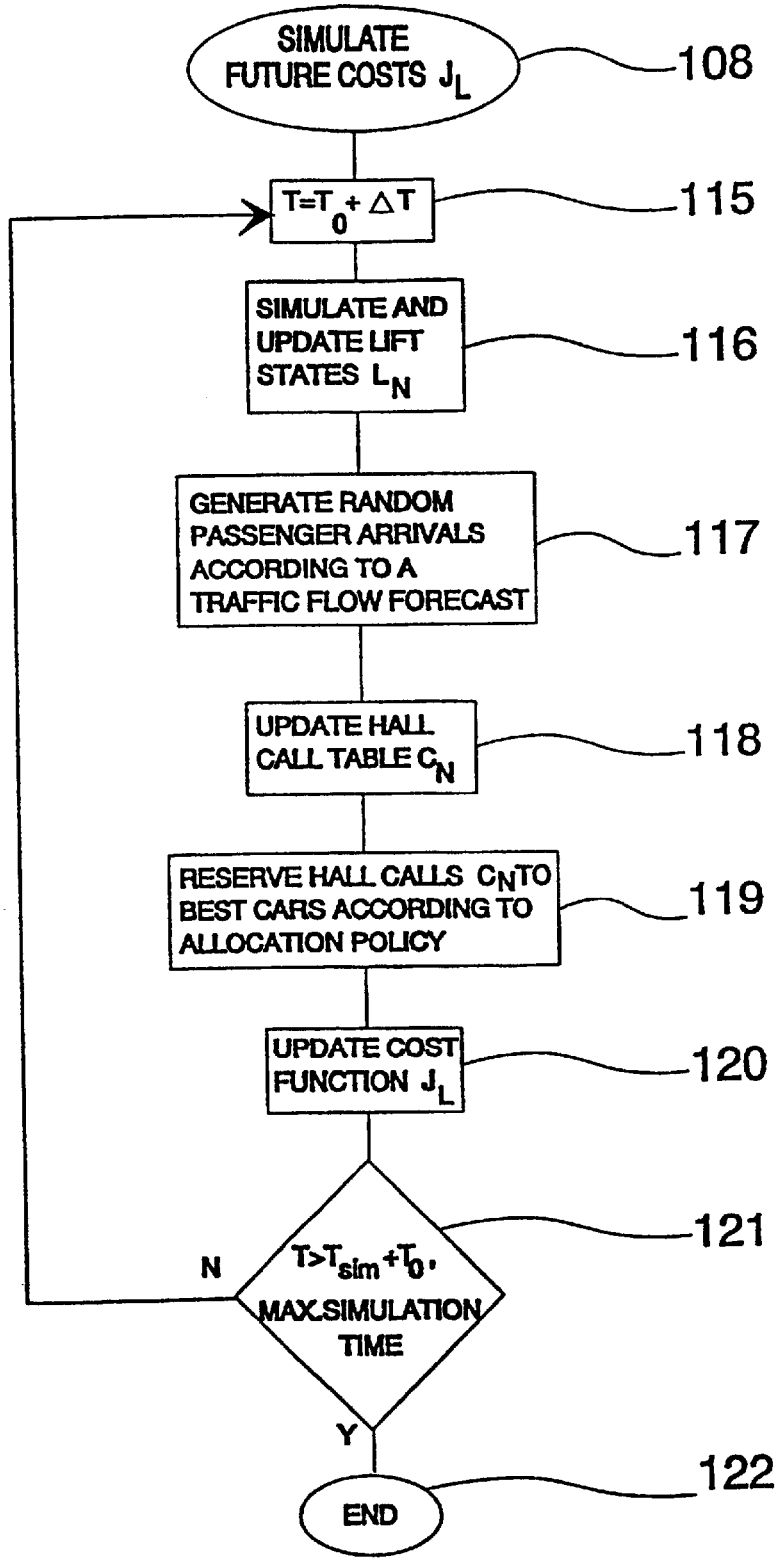
FIG. 5 presents a block diagram representing the simulation of future costs.

FIGS. 4 and 5 present block diagrams representing an embodiment of a solution according to the invention.

The system illustrated by FIG. 4 works as follows: After the start 100, the elevator states $L_s$, landing call states $C_0$ and the time $T_0$ are updated (block 101). Next, the landing calls LO are checked (block 102) one by one to determine whether the call is a 'fixed' one (block 103). If it is not, then the procedure is resumed from block 102. At the same time, the estimated remaining travelling time or time of arrival ETA to/at the floor of the call for fixed calls is updated (block 199). On the other hand, if the call is not fixed, the elevator to serve the call is specified as L=1 and the number of elevators is determined (block 104). After this, the landing call table $C_0$ to $C_N$ and the elevator states $L_S$ to $L_N$ are copied (block 105). Next, the time is set to $T=T_0$ (block 106) and an unfixed call is allocated to elevator L (block 107).

After this, the future costs $J_L$ (block 108) are simulated, the optimum $J_L{}^*$ is selected (block 109) and the call is allocated to the preferable elevator L* in state $C_0$ (block 110). Next, to determine whether the landing call for elevator L* falls within the time window $T_W$, the estimated time of arrival of the elevator is compared with the call $C_0$ and the time limit $T_{Lim}$ (block 111). If the time of arrival is greater than the time limit $T_{Lim}$, then the procedure is resumed from block 102. If it is lower or equal to the time limit $T_{Lim}$ then the call reservation for elevator L is fixed in landing call state $C_0$ (block 112). Finally, old fixed calls are checked. If the call is not served within a certain time (the certain time is $T_{Lim}$ multiplied by a given coefficient; the value of the coefficient being at least one), then the call state is changed to unfixed (block 113) before the procedure is ended 114. The procedure represented by FIG. 4 is repeated at least once in each group control cycle.

FIG. 5 is a block diagram giving a more detailed illustration of the simulation of future costs $J_L$ (block 108). In this procedure, the time T of simulation is first computed as the sum of the current instant $T_0$ and an incremental time $\Delta T$ (block 115). After this, the elevator states $L_N$ are simulated and updated (block 116) and random arrivals of passengers are generated in accordance with a traffic flow forecast (block 117). Next, the landing call table $C_N$ is updated (block 118), the landing calls $C_N$ are allocated to the best elevator cars according to the allocation policy (block 119) and the cost function $J_L$ is updated (block 120). Finally, a check is carried out to determine whether the time T is greater than the sum of the simulation time $T_{sim}$ and the starting instant $T_0$, this sum corresponding to the maximum simulation time (block 121). If it is, then the procedure is ended (block 122). If not, the procedure is resumed from block 115.

It is obvious to a person skilled in the art that different embodiments of the invention are not restricted to the examples presented above, but that they may be varied within the scope of the claims presented below.

What is claimed is:

1. A method of controlling an elevator group including two or more elevators driven by hoisting machines and collectively controlled by a group control that adaptively assigns elevators to calls comprising:

a) receiving a new landing call;

b) simulating probable future landing calls responsive to activating the new landing call;

c) allocating the probable future landing calls to the elevator group on the basis of the simulation of step b); and d) reallocating the elevator group to one or more old calls based on the simulation if a time period for reserving the one or more old calls has not been exceeded.

2. The method of claim 1, wherein said step (c) of allocating generates a statistical simulation of virtual passenger traffic generated on the basis of distribution and intensity of the passenger traffic prevailing at the moment.

3. The method of claim 1, wherein said step (c) of allocating generates the statistical simulation including calls, car commands, elevator states and elevator movements.

4. The method of claim 3, wherein, said simulation further includes that, passengers are generated for different floors in proportion to the arrival intensities and distributions, car commands are generated in accordance with probable intensities of passengers leaving the elevators, an arrival time, arrival floor and destination floor are assigned for each simulated person, the simulated persons give simulated landing calls and car commands, and elevator traffic is simulated according to the next stopping floor used in the simulation, selected by the control system.

5. The method of claim 4, wherein for each new landing call is registered in said step (a), simulation is immediately carried out in said step (b) for different elevators and the call is allocated to the one that gives minimum costs.

6. The method of claim 1 wherein the allocation is determined on the basis of computed elevator-specific cost for the call including a predicted cost of serving the new landing call and an additional cost due to the virtual traffic.

7. The method of claim 1 further including performing simulation and call reallocation even for old calls that are only going to be served after a certain length of time ($T_{Lim}$), and performing simulation of future operation regarding these calls using even calls that, one mode subsequent to a call assignment have to a elevator of said group.

8. The method of claim 1 wherein said simulation in said step b) is also based on forecast landing destinations.

9. The method of claim 8 wherein said step c) of allocating assigns the best car to answer all of the received elevator calls so that said group control produces a reduced average time between elevator call and delivery to destination floor.

* * * * *

UNITED STATES PATENT AND TRADEMARK OFFICE

CERTIFICATE OF CORRECTION

PATENT NO. : 6,345,697 B1
DATED : February 12, 2002
INVENTOR(S) : Marja-Liisa Siikonen It is certified that error appears in the above-identified patent and that said Letters Patent is hereby corrected as shown below:

Title page,
Item [63], please replace to read as follows:
-- [63] Continuation of application No. PCT/FI98/00791, filed on October 9, 1998. --

Signed and Sealed this

Fifth Day of November, 2002

*Attest:*

*Attesting Officer*

JAMES E. ROGAN
*Director of the United States Patent and Trademark Office*